United States Patent [19]

Simons et al.

[11] Patent Number: 4,750,225

[45] Date of Patent: Jun. 14, 1988

[54] QUILT AND PUPPET COMBINATION

[76] Inventors: Kenneth A. Simons; Janice K. Simons, both of 216 Adam Dr., Belleville, Ill. 62221

[21] Appl. No.: 29,626

[22] Filed: Mar. 24, 1987

[51] Int. Cl.[4] ..... A47G 9/00

[52] U.S. Cl. ..... 5/485; 5/502; 446/327

[58] Field of Search ..... 5/482, 485, 486, 502; 446/327

[56] References Cited

U.S. PATENT DOCUMENTS

| | | | |
|---|---|---|---|
| 1,587,387 | 6/1926 | Lichtman | 5/482 X |
| 1,724,443 | 8/1929 | Wheeler . | |
| 2,655,762 | 10/1953 | Burke | 446/327 |
| 3,120,721 | 2/1964 | Bukatman et al. | 5/485 X |
| 3,308,479 | 3/1967 | Sesco, Jr. . | |
| 3,789,546 | 2/1974 | Morrison . | |
| 4,062,076 | 12/1977 | Albertson . | |
| 4,138,745 | 2/1979 | Greenspan | 446/327 X |
| 4,244,141 | 1/1981 | Crawford . | |
| 4,442,558 | 4/1984 | Alexander | 5/494 |
| 4,508,515 | 4/1985 | Skolnick | 446/327 X |
| 4,590,633 | 5/1986 | Pickens | 5/482 |

OTHER PUBLICATIONS

Best Catalog, item 9, "Fold 'N Go" Activity Quilt made by Playskool, p. 31.

*Primary Examiner*—Michael F. Trettel
*Attorney, Agent, or Firm*—Senniger, Powers, Leavitt and Roedel

[57] ABSTRACT

A quilt and hand puppet combination comprising a sheet of material having top and bottom surfaces, a scene on the top surface of the sheet including a doorway, and at least one puppet attached to the sheet at the base of the doorway in position to be part of the scene. A hole in the sheet aligned with the puppet gives access to the interior of the puppet from the bottom surface of the sheet to operate the puppet. A pocket sized to receive the puppet may be integrated into the scene, preferably over the doorway, to give the appearance that the puppet enters and leaves the scene.

4 Claims, 2 Drawing Sheets

QUILT AND PUPPET COMBINATION

BACKGROUND OF THE INVENTION

This invention relates generally to a quilt and puppet combination, and in particular to a quilt having a scene thereon and having a hand puppet attached to the quilt in position to be part of the scene.

Dolls and puppets have been associated with children's quilts, blankets, and bedding to enhance their appearance and amuse the child. In Sesco, Jr., U.S. Pat. No. 3,308,479, for example, a puppet is attached to a protective cloth to amuse the child. However, attaching the puppet to the quilt, blanket, or sheet restricts play and thus limits the child's interest.

SUMMARY OF THE INVENTION

It is among the objects of the present invention to provide a quilt and puppet combination that attracts and holds a child's interest and provides a them for play; it is therefore among the objects of the present invention to provide a quilt with a scene thereon and a puppet attached to the quilt and sized and positioned to be part of the scene. It is also among the objects of the present invention to provide such a quilt and puppet combination wherein the scene includes some type of doorway. It also object of the present invention to provide such a quilt wherein the scene has a particular recognizable theme and wherein the puppet represents a character associated with that theme. It is an object of one embodiment of the present invention to incorporate a pocket into the scene into which the puppet can be inserted to hide the puppet from view; it is a further object of this embodiment that the pocket be incorporated as part of a doorway or opening in the scene to give the appearance that the puppet enters and leaves the scene.

Generally, the quilt and hand puppet combination of the present invention comprises a sheet of material having top and bottom surfaces, and a scene on the top surface of the sheet. A puppet, comprising a head and a sleeve-like body, is attached to the top surface of the sheet and is sized and positioned to be part of the scene. A hole extends through the quilt in alignment with the sleeve-like body of the puppet, to give access to the interior of the puppet from the bottom of the quilt to operate the puppet.

To maintain the child's interest and provide a theme for play, it is important that quilt and puppet combination be constructed so that the puppet appears to be part of the scene. The scene on the quilt preferably relates to a particular recognizable theme and the design and includes a doorway or opening. The puppet preferably represents some character associated with that theme, and is sized and positioned to be a part of the scene. The puppet is preferably positioned at or over the base of the doorway or opening in the design. A pocket for receiving the puppet may be incorporated into the scene, preferably over the doorway or opening. The pocket would then open at the base to receive the puppet and give the appearance that the puppet enters and leaves the scene. The pocket also serves as a convenient place to store and hold the puppet when not in use.

Other objects and features will be in part apparent and in part pointed out hereinafter.

DETAILED DESCRIPTION OF THE PREFERRED EMBODIMENT

Figure 1:
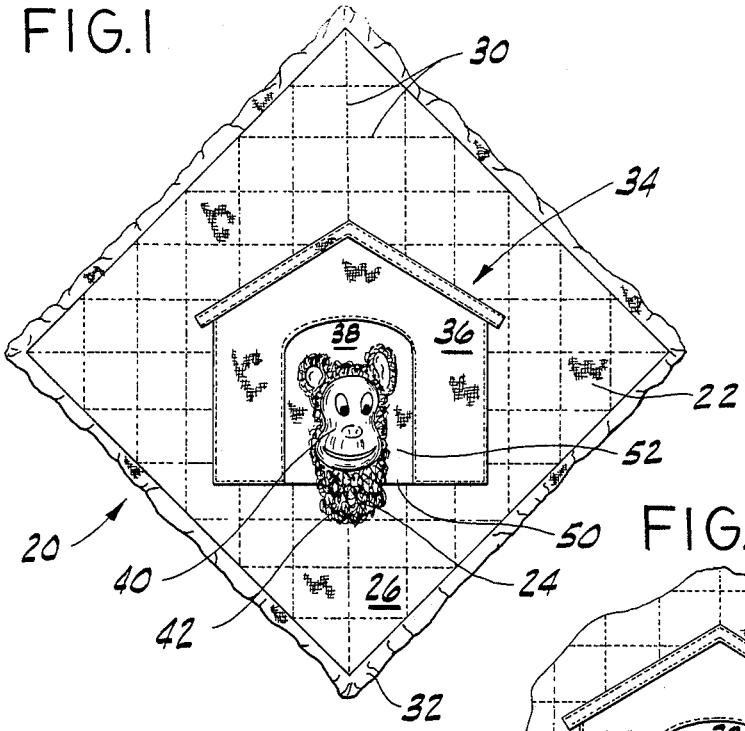
FIG. 1 is a top plan view of a quilt and puppet combination constructed according to the principles of the present invention, showing the puppet extending over a scene on the quilt.
Figure 2:
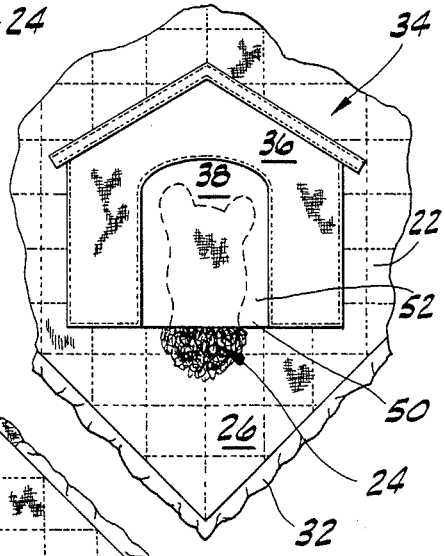
FIG. 2 is a partial top plan view of the quilt and puppet combination, showing the puppet.
Figure 3:
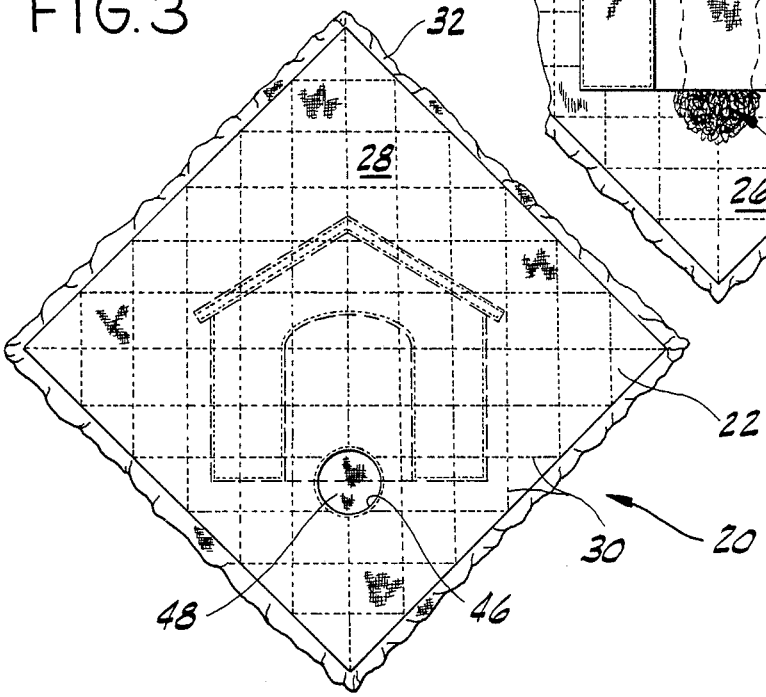
FIG. 3 is a bottom plan view of the quilt and puppet combination, showing the access hole for operating the puppet.
Figure 4:
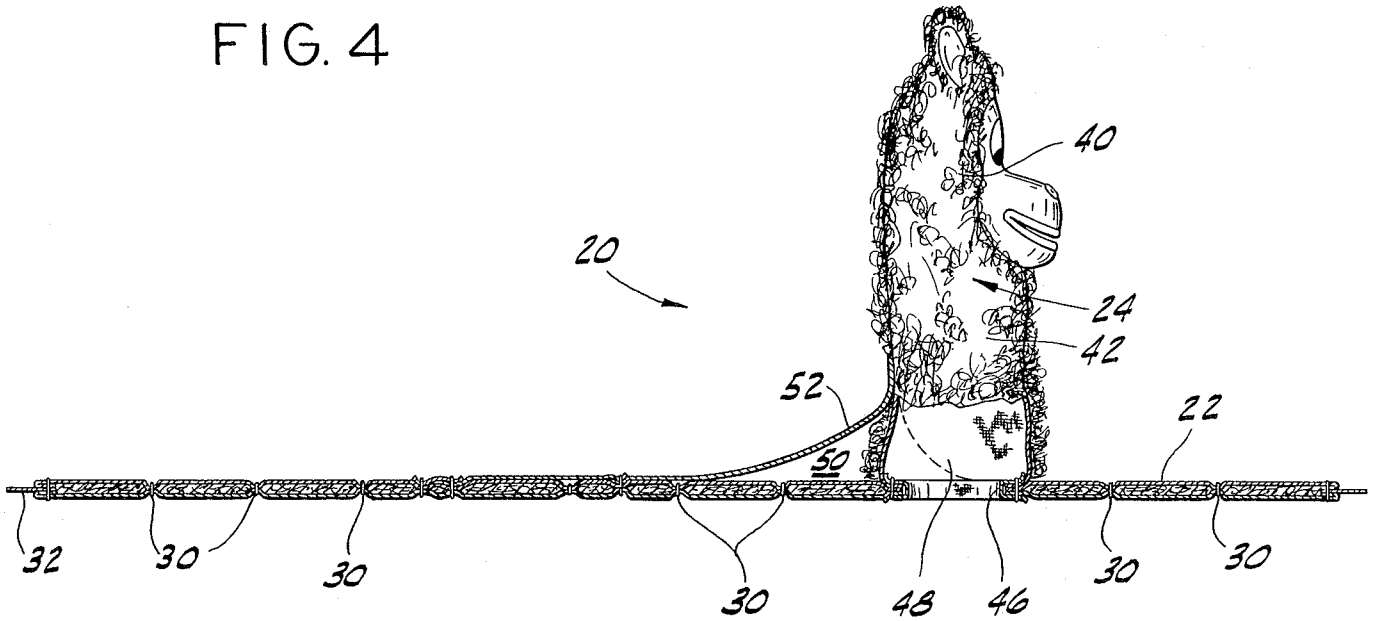
FIG. 4 is a cross sectional-view of the quilt and puppet combination showing the puppet extending outwardly from the quilt.

A quilt and puppet combination constructed according to the principles of this invention, indicated generally as 20 in FIGS. 1–4, is shown in the drawings as comprising quilt 22 and puppet 24. The term quilt as used herein includes any quilt, blanket, sheet, or similar item, although in the preferred embodiment a quilt is used.

Quilt 22 comprises a top surface 26 and a bottom surface 28, which sandwich a layer of batting material (not shown) between them. As is known, quilt 22 can have a pattern of stitches 30 or "quilting" therein. A decorative border 32 may also be secured about the peripheral edge of the quilt 22. A scene 34 is depicted on the top surface of the quilt 22, for example by cloth cut-outs stitched thereto. Any other means for depicting the scene, for example printing or stenciling, could be used. As shown in the figures the scene 34 comprises a dog house 36 having a doorway 38, but the present invention is not limited to this scene, and another scene could be used. It is preferred that the scene include a dwelling or other structure having a doorway therein. Doorway, as used herein can include any opening, such as a gate, passage, hole, or lid.

Hand puppet 24 comprises a head 42 and a sleeve-like body portion 44. The top of the sleeve-like body portion is attached to the bottom of the head 42, and the bottom of the sleeve-like body portion is attached to the top surface of the quilt, in position to be part of the scene 34. The sleeve-like body portion can be shaped to appear like a body, and can even include arms, legs or other body parts. To enhance the appearance that the puppet is part of the scene, the combination is preferably constructed so that the puppet is attached to the quilt at the base of the doorway in the scene, and preferably overlaps the base of the doorway. As shown in the figures, the bottom of the puppet 24 is positioned to overlap the base of the doorway 38 of dog house 36 in scene 34. The puppet 34 thus extends in front of the doorway 40. As shown in the figures, puppet 24 is a dog, but the invention is not so limited, and another character could be used. To enhance the appearance that the puppet is part of the scene, the combination is preferably constructed so that the scene on the quilt relates to a particular recongizable theme, and the puppet represents a character associated with that theme.

A hole 46 extends through quilt 22 in alignment with the sleeve-like body 42 of puppet 24, providing an opening 48 in the bottom surface of the quilt through which a hand can be inserted to operate the puppet 24.

To enhance the appearance that the puppet is part of the scene, and to make the combination more interesting to the child, the combination is preferably constructed with a pocket 50, into which the puppet can be manipulated, incorporated into the scene. The pocket 50 is preferably positioned over a doorway in the scene. As shown in the figures, pocket 50 is formed over the doorway 38 in the dog house 36 depicted in the scene 34. The pocket 50 is formed by a panel 52 attached over the quilt around the peripheral edges of the panel as with stitching, except along one side to define an opening for receiving the puppet. The pocket opening is formed to face the puppet, preferably along the base of the doorway, to facilitate manipulating the puppet into the pocket. Instead of a pocket, a flap (not shown) can be positioned over the doorway. The flap would also hide the puppet from view. The puppet may be positioned to overlap the base of the doorway in the scene. In that case, the panel 52 can be provided with a cut-out (not shown) to accommodate the body portion of the puppet so the panel 52 will lie flat when the puppet is out of the pocket. As explained above, the present invention is not limited to the particular scene shown in the figures. Another scene could be used in the invention, but preferably the scene includes a doorway and a pocket is incorporated into the scene at such doorway. When the combination is constructed this way the puppet can be manipulated into the pocket to give the illusion of entering and exiting the scene. The pocket also provides a convenient place to store the puppet when not in use.

The present invention thus provides a quilt and puppet combination that is more than a puppet attached to the quilt. The combination is constructed to attract and hold the child's interest. The quilt includes a scene with a theme that sparks the child's interest and gives a theme for play. It provides a background for the puppet making playing more interesting and holding the child's attention longer. The pocket incorporated into the design as a doorway heightens the child's interest in the combination and encourages interaction between the child and the device.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. A quilt and hand puppet combination comprising:
a sheet of material having top and bottom surfaces;
means for depicting a scene on the top surface of the sheet, said means including means for depicting a doorway;
at least one puppet comprising a head and a sleeve-like body attached at the upper end to the head and at the lower end to the top surface of the sheet adjacent the doorway, and in position to be part of the scene;
means for defining a hole through the sheet aligned with the sleeve-like body of the puppet to give access to the interior of the puppet from the bottom surface of the sheet to operate the puppet; and
means for defining a pocket on the sheet over the doorway in the scene, the means defining the pocket comprising a panel attached over the doorway in the scene around the peripheral edges of the panel except for a portion of sufficient size to define an opening to receive the puppet therethrough, the puppet being positioned to be manipulated into the pocket to hide the puppet from view.

2. A quilt and hand puppet combination comprising:
a sheet of material having top and bottom surfaces;
means for depicting a scene on the top surface of the sheet, said means including means for depicting a doorway;
at least one puppet comprising a head and a sleeve-like body attached at the upper end to the head and at the lower end to the top surface of the sheet, the puppet being positioned at the base of the doorway in the scene in position to be part of the scene;
means for defining a hole through the sheet aligned with the sleeve-like body of the puppet to give access to the interior of the puppet from the bottom surface of the sheet to operate the puppet; and
means for defining a pocket on the sheet over the doorway in the scene comprising a panel attached over the doorway in the scene around its peripheral edges except for the bottom edge to define an opening to receive the puppet therethrough, the puppet being positioned to be manipulated into the pocket to hide the puppet from view.

3. A quilt and hand puppet combination comprising:
a sheet of material having top and bottom surfaces;
means for depicting a scene on the top surface of the sheet, the scene including a doorway therein;
at least one puppet comprising a head and a sleeve-like body attached at the upper end to the head and at the lower end to the surface of the sheet, at the base of the doorway in position to become part of the scene;
means for defining a hole through the sheet aligned with the sleeve-like body of the puppet, to give access to the interior of the puppet from the bottom surface of the sheet to operate the puppet; and
means for defining a pocket over the doorway in the scene into which the puppet can be manipulated to hide the puppet from view the means defining the pocket comprising a panel attached over the doorway in the scene around the peripheral edges of the panel except for a portion of sufficient size to define an opening to receive the puppet therethrough.

4. A quilt and hand puppet combination comprising:
a sheet of material having top and bottom surfaces;
means for depicting a scene on the top surface of the sheet, the scene including a doorway thereon;
at least one puppet comprising a head and a sleeve-like body attached at the upper end to the head and at the lower end to the surface of the sheet, at the base of the doorway in position to become part of the scene;
means for defining a hole through the sheet aligned with the sleeve-like body of the puppet, to give access to the interior of the puppet from the bottom surface of the sheet to operate the puppet; and
means for defining a pocket over the doorway in the scene into which the puppet can be manipulated to hide the puppet from view the means for defining the pocket comprising a panel attached over the doorway in the scene around its peripheral edges except for the bottom edge to define an opening to receive the puppet therethrough.

* * * * *